US005212494A

United States Patent [19]

Hofer et al.

[11] Patent Number: 5,212,494

[45] Date of Patent: May 18, 1993

[54] COMPACT MULTI-POLARIZED BROADBAND ANTENNA

[75] Inventors: Dean A. Hofer, Richardson; Oren B. Kesler; Lowell L. Loyet, both of Plano, all of Tex.

[73] Assignee: Texas Instruments Incorporated, Dallas, Tex.

[21] Appl. No.: 608,606

[22] Filed: Oct. 31, 1990

Related U.S. Application Data

[63] Continuation of Ser. No. 339,774, Apr. 18, 1989, abandoned.

[51] Int. Cl.[5] ..... H01Q 11/10

[52] U.S. Cl. ..... 343/859; 343/792.5

[58] Field of Search ..... 343/792.5, 789, 700 MS File, 343/859

[56] References Cited

U.S. PATENT DOCUMENTS

| | | | |
|---|---|---|---|
| 4,527,164 | 7/1985 | Cestaro et al. | 343/713 |
| 4,594,595 | 6/1986 | Struckman | 343/792.5 |
| 4,608,572 | 8/1986 | Blakney et al. | 343/792.5 |
| 4,616,233 | 10/1986 | Westerman | 343/792.5 |
| 4,658,262 | 4/1987 | DuHamel | 343/792.5 |
| 4,772,891 | 9/1988 | Svy | 343/792.5 |
| 4,843,403 | 6/1989 | Lalezari et al. | 343/700 MS |

*Primary Examiner*—Michael C. Wimer

*Attorney, Agent, or Firm*—Jay M. Cantor; René E. Grossman; Richard L. Donaldson

[57] ABSTRACT

The disclosure relates to a multipolarized broad band antenna and antenna system wherein the antenna structure is formed on a substrate, the antenna structure on the substrate including a central feedpoint, a first antenna element having a plurality of regions composed of first plural interconnected concentric sectors of circles of diminishing radius extending to the feedpoint, and a second antenna element having a plurality of regions composed of second plural interconnected concentric sectors of circles of diminishing radius extending to the feedpoint, the second plural concentric sectors being interleaved with the first plural concentric sectors.

40 Claims, 8 Drawing Sheets

23
24
32
31
33
18
19
20
21

34
35
36
37
39
38
10
16
12
11
13
14
15
17
22

61
60
59

57

53

63
60
62

51
52
53
54
55
64
58
57
63

COMPACT MULTI-POLARIZED BROADBAND ANTENNA

This application is a continuation of application Ser. No. 07/339,774, filed Apr. 18, 1989, abandoned.

BACKGROUND OF THE INVENTION

1. Field of the Invention

This invention relates to broadband antennas and, more specifically, to broadband antennas of compact size which are capable of receiving or transmitting multi-polarized electromagnetic radiation.

2. Brief Description of the Prior Art

Antennas are often required to receive or transmit electromagnetic radiation over several octaves of bandwidth while maintaining uniform radiation pattern and impedance characteristics within the operating band. Antennas of this type have been well known in the art for many years and include log periodic and spiral radiating structures. Often however, the polarization of the received electromagnetic signal is unknown and a conventional log periodic or spiral antenna may not respond to the sense of polarization being transmitted. The problem of responding to transmitted signals over a broad band for any sense of polarization (i.e. vertical, horizontal, left hand circular or right hand circular) is difficult and has not been completely solved in the prior art.

The most pertinent prior art of which applicants herein are aware is a patent to DuHamel (U.S. Pat. No. 4,658,262). This patent discloses a log periodic zig zag antenna having four identical zig zag members positioned 90 degrees apart. An RF processor consisting of two 180 degree Marchand baluns and a 90 degree hybrid, remote from the antenna, is used to feed a transmission line extending from a cavity in the base region of the antenna housing, upward along the antenna axis and attaching to the antenna central feedpoint.

A common failure mode of cavity backed antennas which are fed at the central feedpoint with a transmission line positioned on the antenna axis is that of mechanical separation between the antenna and transmission line. The failure usually occurs when the antenna is subjected to environmental stress such as thermal cycling or vibration. This problem exists because the thin circular antenna substrate, which is permanently attached to the cavity at its perimeter, acts as a diaphragm and moves up and down at the center (feed point region) due to thermal cycling and vibration. When this movement occurs, the antenna pulls loose from the transmission line attached to the central feedpoint, resulting in complete electrical failure. As will be demonstrated hereinbelow, the present invention eliminates this problem because the antenna transmission line is attached at the perimeter of the antenna (diaphragm) where there is no movement between the antenna and the feeding transmission line and, thus, there is far less stress at the antenna/feed connection interface.

SUMMARY OF THE INVENTION

The present invention provides, the above noted desired properties of a broadband unidirectional antenna response, independent of polarization, with concomitant freedom from mechanical feedpoint failure.

Briefly, this is accomplished by providing two printed circuit interleaved log periodic dipole elements disposed orthogonal to each other. The interleaved log periodic elements are etched on a dielectric substrate and placed over an absorber loaded cavity backing to provide unidirectional broadband performance similar to that of a cavity backed planar spiral antenna. The log periodic elements are preferably, but not limited to, a copper etched circuit and the dielectric (electrically insulating) substrate is preferably, but not limited to Fiberglas or polytetrafluoroethylene (Teflon) glass (e.g. Duroid type 5880). The interleaved log periodic elements are in the form of circular arcs to efficiently utilize the available space in the circular aperture. The radial distance from the antenna center to the inner (rn) and outer (Rn) arcs of each of the dipole arms is scaled by a constant factor tau, wherein $\text{tau}=R_{(n+1)}/R_n$ as shown in FIG. 1. The degree of interleaving is controlled by an angle alpha wherein, as alpha increases, interleaving becomes greater. The sigma symbol in FIG. 1 controls individual element width. The term w is the width of the transmission line transporting RF energy to and from each of the radiating elements of the antenna wherein change in w will change the impedance of the transmission line.

Furthermore, the antenna in accordance with the present invention is connected to the feeding transmission line at the antenna perimeter rather than at the central antenna feedpoint as is common for other cavity backed broadband antennas, including that of the nearest known prior art described in DuHamels U.S. Pat. No. 4,658,262. This offers a distinct reliability advantage.

Briefly, this is accomplished by having the energy received by the antenna enter at the antenna active region (approximately the one wavelength circumference region) and flow from the central antenna feedpoint radially outward therefrom to the outer perimeter of the antenna substrate (diaphragm) via a pair of orthogonal printed circuit (coaxial, microstrip or stripline) baluns. These baluns, (commonly called infinite baluns because of their unlimited bandwidth) are an integral part of the etched antenna substrate and replace the need for two separate Marchand baluns as described in DuHamel's U.S. Pat. No. 4,658,262. At the outer perimeter of the antenna, baluns are connected to a coaxial line which transports the received signal to the printed circuit 90 degree hybrid located at the base region of the antenna. The outputs of the 90 degree hybrid provide left hand circular and right hand circular polarized ports.

If only dual linear (horizontal and vertical) polarizations are required, the outputs may be taken directly off of the balun ports without need for the 90 degree hybrid. Thus, the antenna has multiple polarized capability for a single radiating aperture. For some applications, it may be required that the antenna have only one output port, yet have dual polarized capability. This is accomplished by incorporating a single pole two throw PIN diode, FET or mechanical switch between the 90 degree output ports of the hybrid and the single antenna output port. The switch in the described embodiment consists of a PIN diode type commonly available from a microwave component supplier such as M/A-COM Semiconductor Products of Burlington, Mass. 01803. All of the components of the invention including antenna radiating aperture (interleaved log periodic dipole elements), polarization processor (printed circuit infinite baluns, 90 degree hybrid with coaxial interface), absorber loaded antenna cavity and polarization selection switch are housed in a single housing.

DESCRIPTION OF PREFERRED EMBODIMENTS

Figure 5:
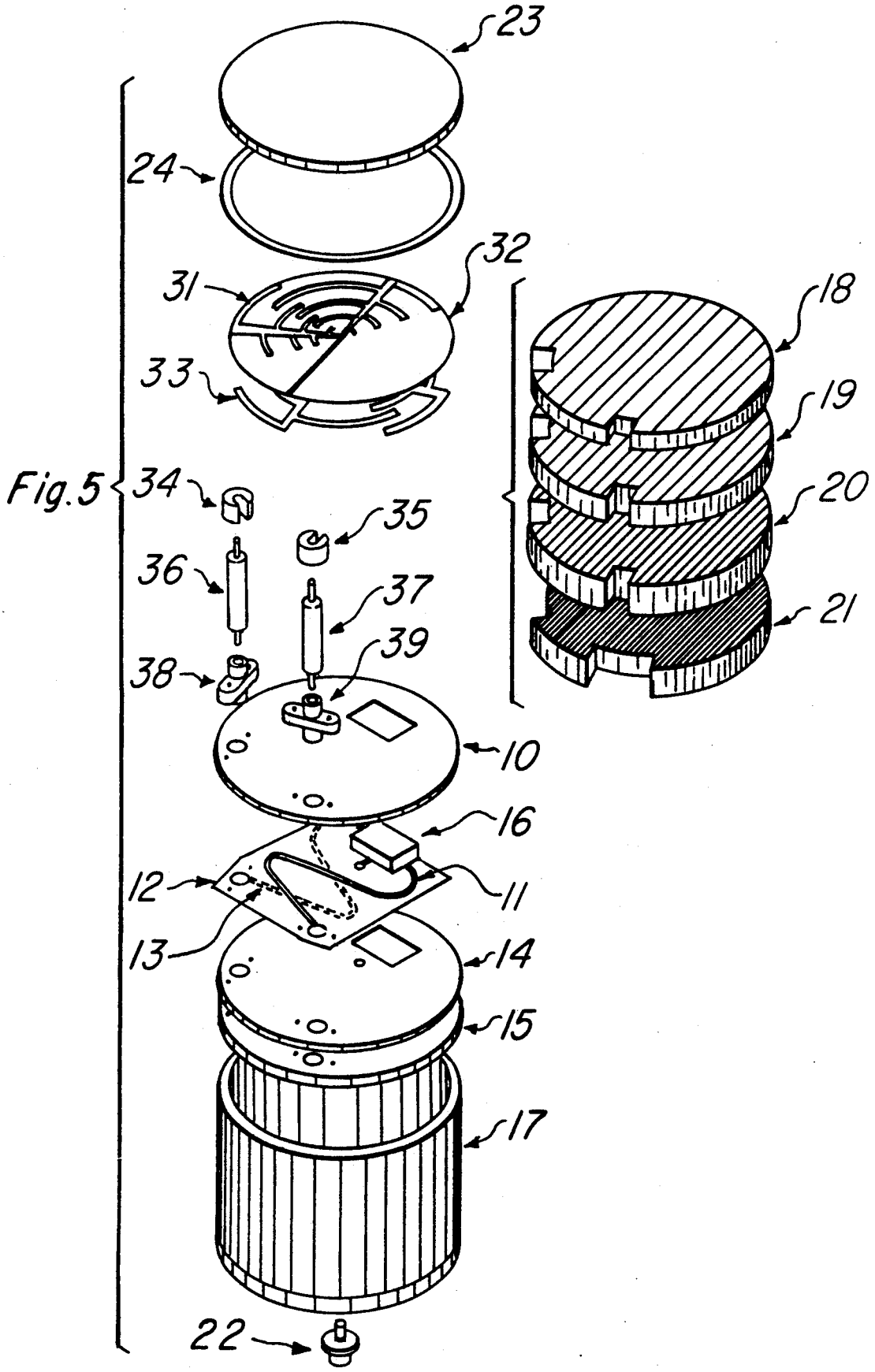
FIG. 5 shows an exploded view of the antenna components and their relative position to each other.

Functional Description—The basic functional components of the antenna assembly are shown in FIG. 5 and consist of: (1) the interleaved log periodic radiating aperture with integral printed circuit infinite baluns which are part of the polarization processor, (2) absorber loading consisting of: (a) the absorber loaded antenna cavity for broadband unidirectional pattern performance, and (b) the termination absorber around the antenna perimeter for enhanced low frequency performance, (3) the polarization processor consisting of: (a) the printed circuit infinite baluns (integral to the radiating structure) and (b) the 90 degree hybrid and (4) the antenna housing and radome cover.

The polarization processor provides appropriate antenna feedpoint excitations, see FIGS. 3(*a*) and 3(*b*), at the four antenna feedpoints located at the center of the radiating aperture. These excitations require equal amplitude at all four antenna feedpoints and sequential phase progressions in increments of 90 degrees for both clockwise and counter clockwise rotations. This excitation provides both left hand and right hand circular polarized antenna outputs from the 90 degree hybrid. The antenna assembly is housed in a metallic cup shaped housing and covered with a dielectric (Fiberglas) radome for environmental protection.

Figure 1:
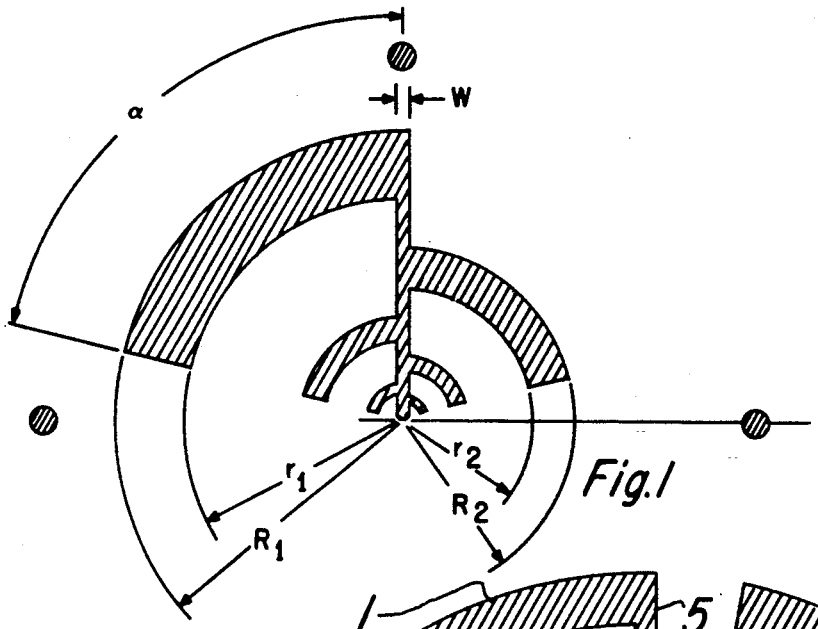
FIG. 1 details the geometry defining a single element of the interleaved log periodic structure.

Detailed Description—Referring first to FIG. 1, there is shown the geometry which describes a printed circuit log periodic structure. Log periodic antennas are discussed in greater detail in the literature, e.g. Antenna Handbook by Y. T. Lo and S. W. Lee, Chapter 9, Frequency Independent Antennas, 1988 Van Nostrand Reinhold Co. Inc. The log periodic geometry is used to lay out an antenna by first defining an antenna element within a single cell, (e.g., between $R_1$ and $r_1$ and between alpha equal to zero and alpha). The same configuration of conductor, properly scaled by the constant scale factor tau, is then reproduced in the other cells. If this process is repeated infinitely many times for smaller cells, the resulting geometry will converge to a point. Likewise, infinite repetition of the larger cells will cause the structure to become infinitely large.

Figure 2:
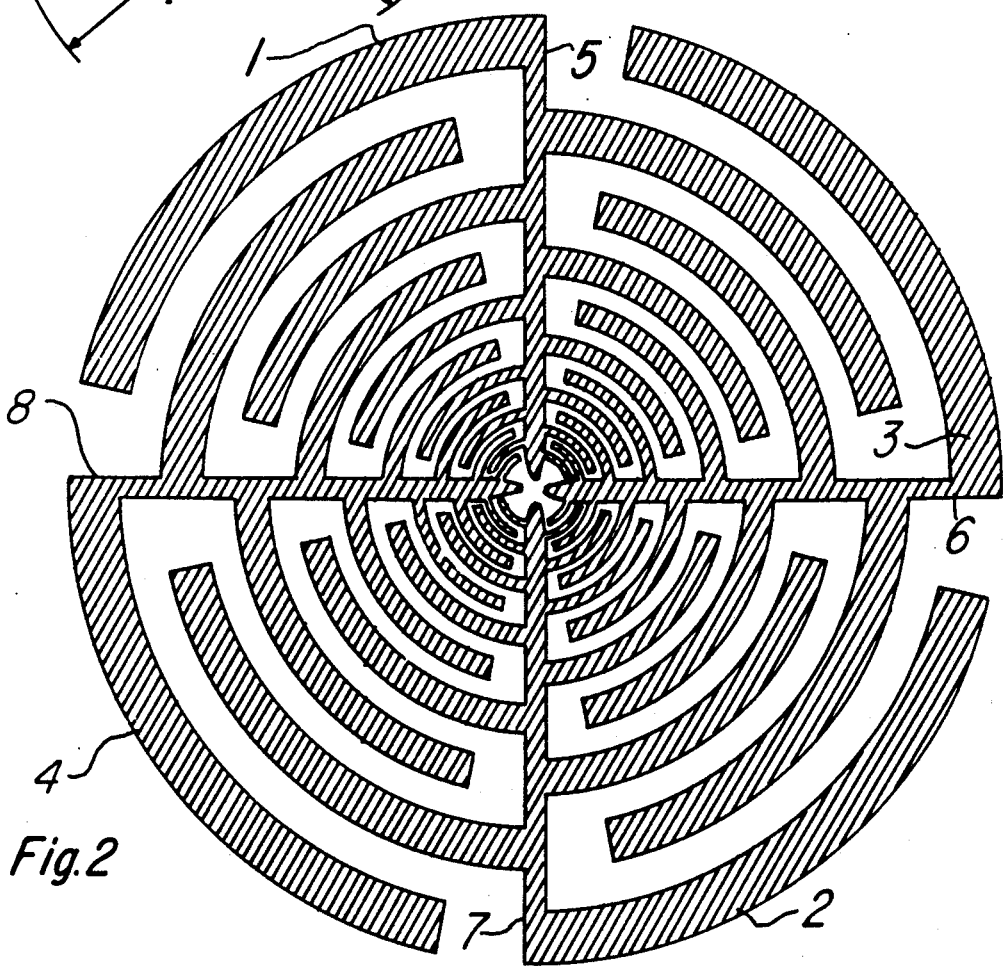
FIG. 2 shows the interleaved geometry of the Compact Multi-Polarized Broadband Antenna radiating aperture.
Figure 3A:
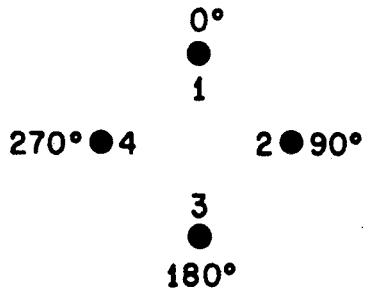
FIGS. 3(*a*) and 3(*b*) show the excitation required to obtain left hand and right hand circular polarizations for a four terminal symmetrical antenna feed point as used in this invention.
Figure 3B:
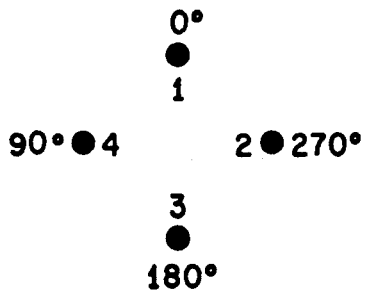

FIG. 2 shows a top view of the unique interleaved log periodic dipole geometry employed in this invention. For the configuration shown in FIG. 2, log periodic dipole sets 1 and 2 are fed with equal amplitude and phase of 0 degrees and 180 degrees respectively at the center feedpoint by microstrip baluns 5 and 7. Likewise, log periodic dipole sets 3 and 4 are fed with equal amplitude and a phase of 90 degrees and 270 degrees respectively at the center feedpoint by microstrip baluns 6 and 8, FIGS. 3*a* and 3*b* show the required antenna feedpoint excitations at the center of the antenna to obtain right hand circular LHCP and left hand circular RHCP polarizations.

Figure 4:
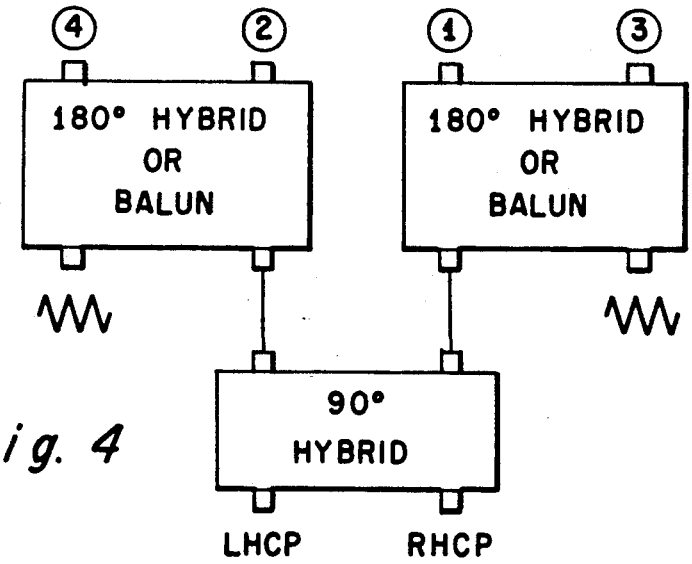
FIG. 4 shows a common method of feeding four symmetrical feed points to obtain left hand and right hand circular polarization, the accepted practice being to have these components remote from the antenna radiating aperture. For the invention described herein, the two baluns are an integral part of the printed circuit antenna radiating aperture for improved reliability and reduced cost.

FIG. 4 shows the conventional manner in which the appropriate excitation is obtained for dual sense circular polarization. This consists of two separate 180 degree hybrids or baluns plus a separate 90 degree hybrid. The described embodiment herein eliminates the two separate 180 degree hybrids or baluns by incorporating them as an integral part of the antenna etched circuit for improved reliability, producibility and lower cost.

In FIG. 5 is shown an exploded view of the antenna assembly of a preferred embodiment in accordance with the present invention. For this preferred embodiment, log periodic antenna elements 31 and 33 are etched on opposite sides of antenna substrate 32. The etched log periodic antenna circuit accommodates orthogonal printed circuit microstrip baluns which lie radially along the center of each set of log periodic elements. These printed circuit baluns are an integral part of the etched log periodic geometry. The orthogonal printed circuit baluns transport energy from the central antenna feed point to the signal extraction points 40 and 41 of FIG. 5, at the antenna perimeter. Coaxial lines 36 and 37 which are connected to remote signal extraction points 40 and 41 of FIG. 5 transport RF energy received by the antenna downward to the 90 degree hybrid consisting of layers 11, 12 and 13. Mode suppressing collars 34, 35, 38 and 39 are used to suppress unwanted higher order modes and launch the received RF signal from the printed circuit antenna balun onto the coaxial line and from the coaxial line onto the stripline 90 degree hybrid. The 90 degree hybrid consists of a dielectric substrate (0.010 inch thick Duroid 5880) 12 and RF coupler circuits 11 and 13 etched on opposite sides of the substrate 12. The 90 degree coupler stripline circuit is completed by the dielectric layers 10 and 14 which are (0.031 inch thick layers of Duroid 5880) metallized on the outside surfaces to form a 90 degree hybrid stripline circuit. The metallized surface of the upper dielectric layer 10 serves as the metallic base for the absorber loaded cavity 17. Design of the 90 degree coupler follows standard methods commonly used by those skilled in the art. The load ring 24 acts as a termination at the outer perimeter of the antenna structure to reduce reflections at the lower operating frequencies. This load ring is made of a carbon loaded epoxy resin and is painted on to the antenna substrate. The structure 15 is the baseplate for the internal antenna/processor/switch subassembly. The subassembly is attached to this base plate 15 to assist in holding it together prior to dropping into the cavity 17. The subassembly is dropped into cavity 17 to make the final assembly. The device 22 is the RF output connector.

The antenna herein described, operates over a bandwidth limited at the high frequencies by physical detail at the central feed region and at the low frequencies by the physical size of the structure. The antenna by itself is a bidirectional radiating element. Because unidirectional radiation is preferred, the antenna is backed by an absorber loaded cavity. The absorber used is graded to allow a gradual transition from a relatively low dielectric constant and low electrical loss material 19, to a medium dielectric constant and medium loss material 20, to a higher dielectric constant and high loss material 21. This allows the back radiation of the antenna to be absorbed with a minimum of reflection from the absorber surface, resulting in uniform pattern and gain performance over the operating band. Typical of the absorbers which can be used for materials 19, 20 and 21 are Emerson and Cumming Co. types LS22, LS24, and LS26. Additionally, a carbon loaded honeycomb absorber, also available from Emerson and Cumming, will work and provide a structural support for the antenna. The antenna performance can be improved by having a 0.125 inch air space between the antenna and the absorber layer 19. In practice, this space can be a structural foam spacer, such as styrofoam, which electrically is similar to air, but yet provides structural support for the antenna. The antenna is dropped into an aluminum cup shaped housing 17 and covered with a dielectric radome 23 for environmental protection.

Figure 6:
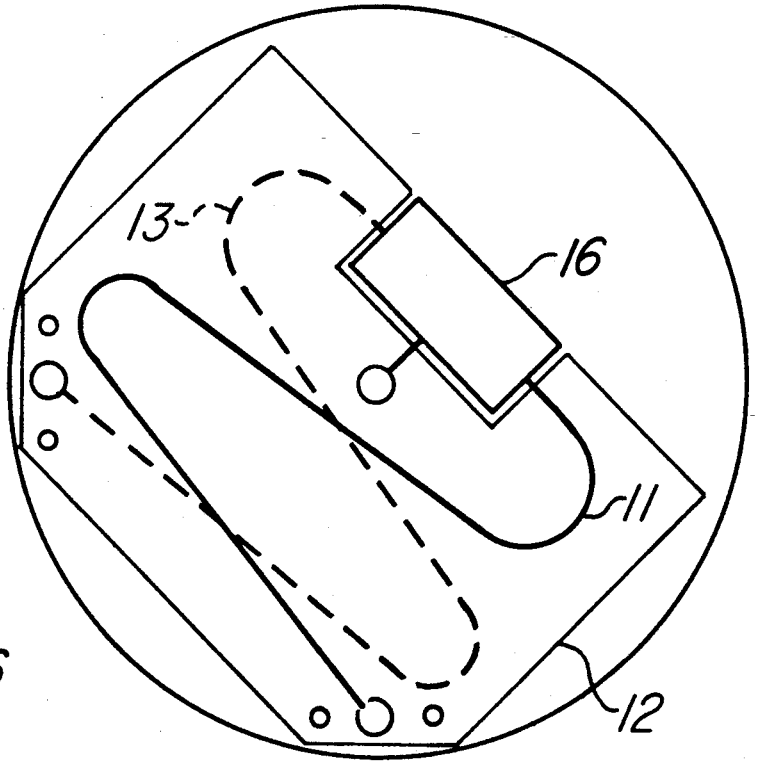
FIG. 6 shows a top view of the 90 degree hybrid and polarization switch.
Figure 7C:
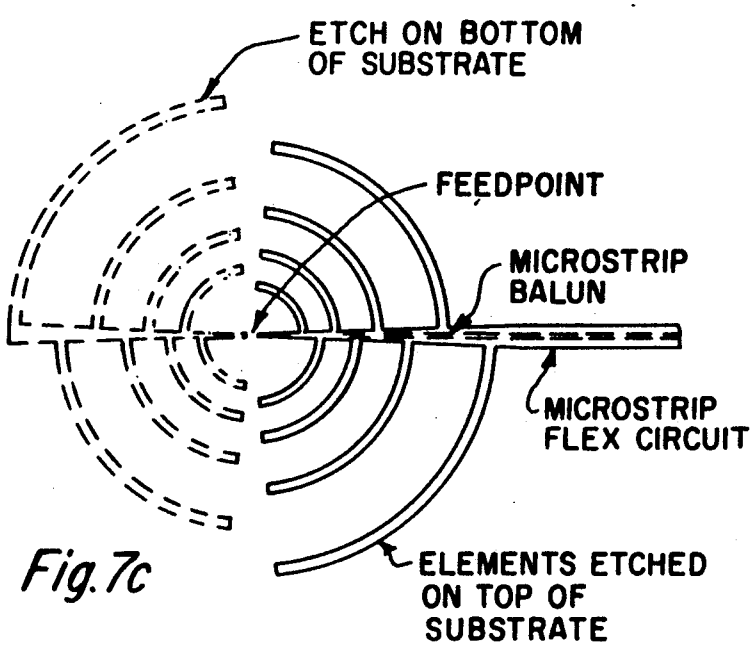
FIG. 7*c* is a second means of implementing the center antenna feedpoint with microstrip or printed circuit baluns employing a completely solderless feed region geometry shown in detail in FIG. 7*d*.
Figure 7D:
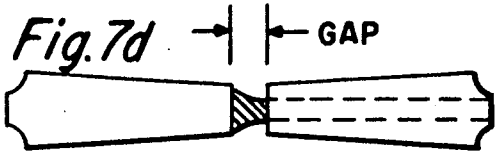
FIG. 7*a* is a first means of implementing the center antenna feedpoint with microstrip or printed circuit baluns employing a shorting pin or plated through hole shown in detail in FIG. 7*b*.
Figure 7A:
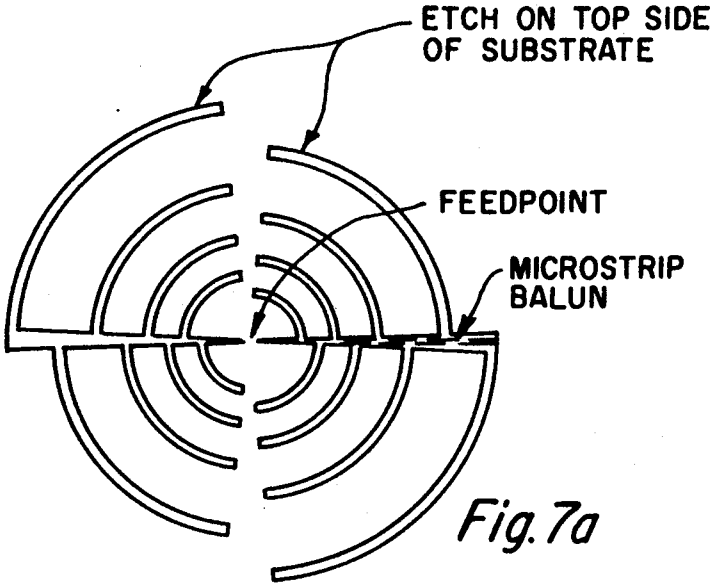
Figure 7B:
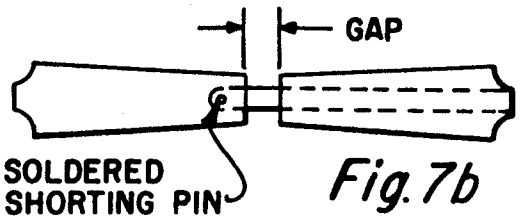
Figures 8A, 8B:
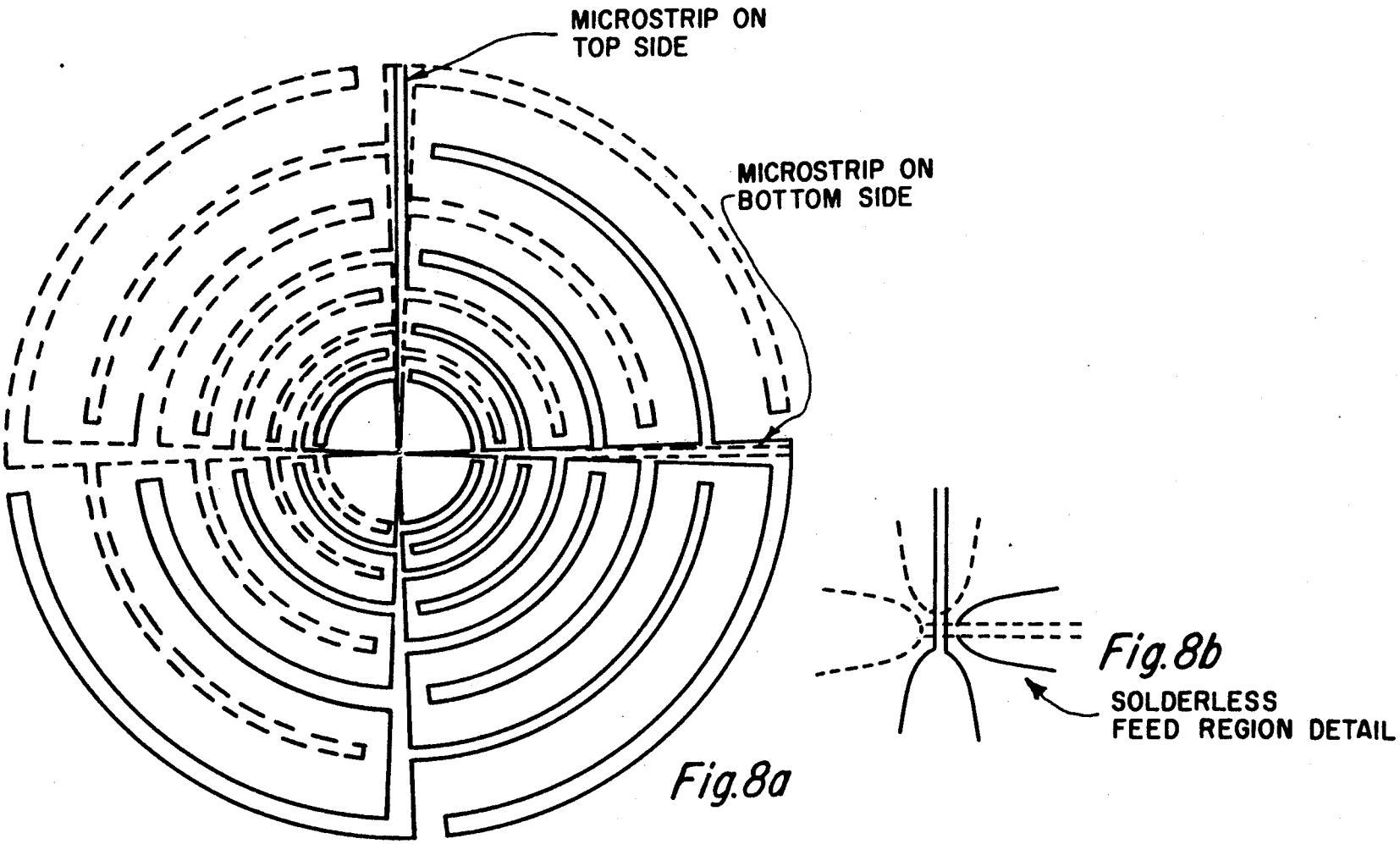
FIG. 8*a* shows the detail of how the orthogonal feed geometry crosses over at the central feedpoint region.
FIG. 8*b* is an exploded view of the feed region of FIG. 8*a*.

FIG. 6 shows a top view of the 90 degree hybrid coupler assembly 11, 12, and 13 plus the polarization selection switch 16 and the polarization switch which provides either RHCP or LHCP to a single output port at the base of the antenna.

There are various means of implementing the detailed feed geometry at the center of the antenna structure. One method is to have the log periodic elements all on one side of the antenna substrate and fed with a printed circuit microstrip or stripline balun as illustrated in FIG. *7a* and *7d*. In this configuration, the microstrip balun conductor on the underside of the substrate must bridge the center feed point gap and connect to the log periodic elements on the left side of the structure by means of a shorting pin or a plated through hole. The shorting pin or plated through hole can be eliminated by placing the log periodic elements on the left side of the structure under the substrate as is illustrated in FIGS. *7c* and *7d* by dashed lines. Here, the microstrip balun conductor which is on the under side of the substrate, bridges the feed point gap and connects directly to the log periodic elements on the left side of the structure.

Figure 9A:
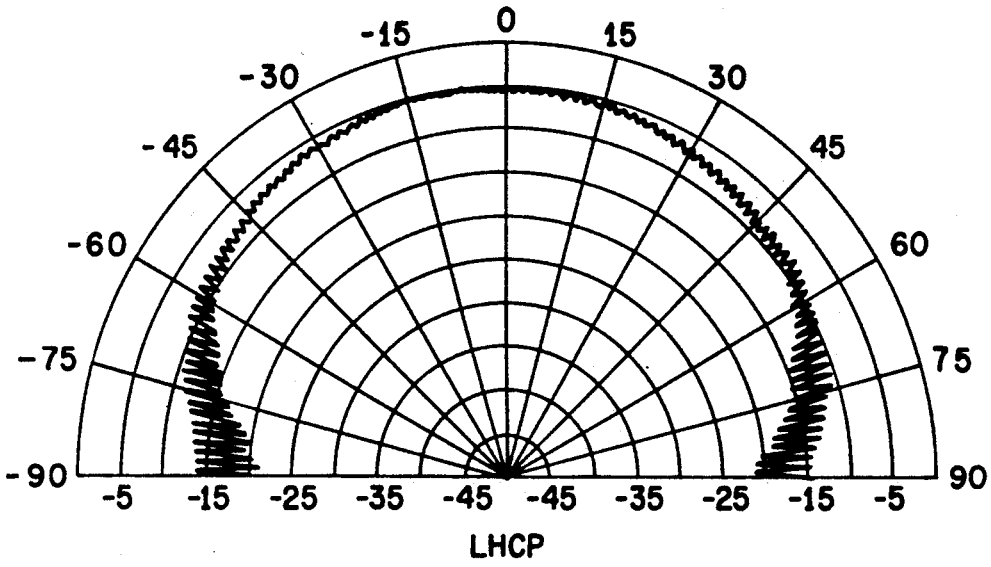
FIGS. 9(*a*) and 9(*b*) show measured left and right hand circular polarized radiation patterns at a single frequency.
Figure 9B:
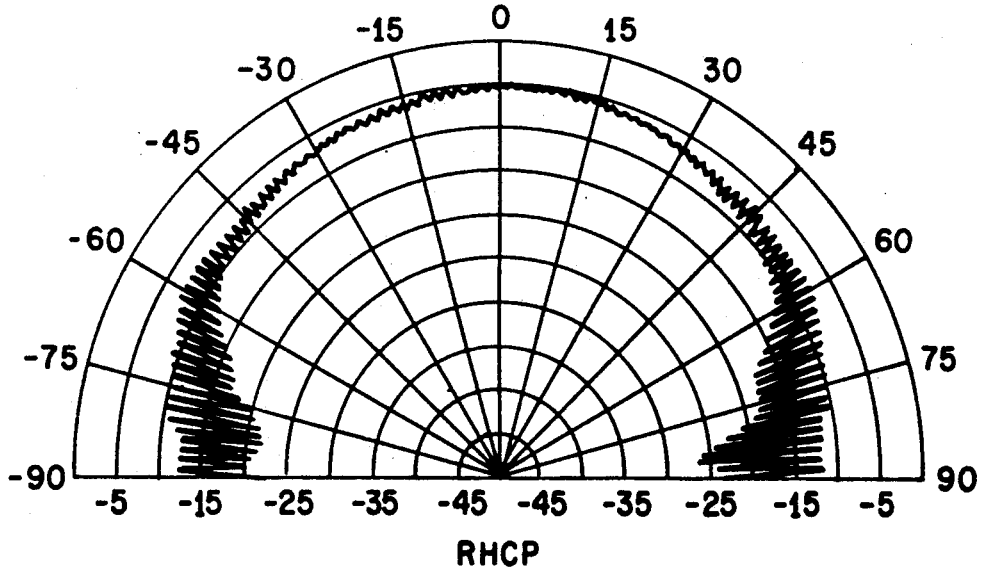

The feed points described in FIGS. *7a* to *7d* can be physically realized for crossed orthogonal log periodic elements as shown in FIGS. *8a* and *8b*. For this arrangement, the orthogonal microstrip baluns are etched on opposite sides of the antenna substrate. The orthogonal geometry keeps the coupling between the baluns to a minimum. Thus, a solderless feedpoint or a feedpoint using the shorting pins can be realized. The key point is that for either case, the feed region at the center of the antenna is not attached to a transmission line running through the antenna cavity to the 90 degree coupler in the antenna base. This is important because the embodiment of this invention is far more reliable than that of conventional cavity backed designs of prior art. FIG. 9 shows typical radiation patterns for right hand and left hand circular outputs.

Figure 11:
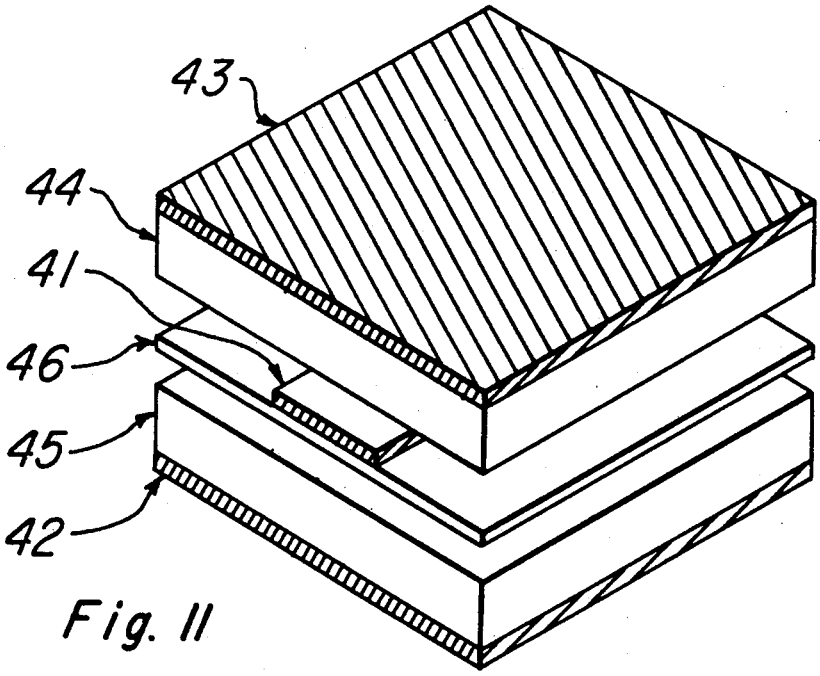
FIG. 11 shows the geometry for a conventional stripline circuit.

Alternate Embodiments—FIGS. 5 and *7a* to *7d* describe a configuration where the antenna is fed by means of two orthogonal microstrip infinite baluns. An alternate feeding method, is to employ two orthogonal infinite baluns in the form of a stripline circuit in lieu of the microstrip balun circuit. A conventional stripline circuit is shown in FIG. 11 where the center conductor 41 of the stripline circuit is suspended between ground planes 42 and 43 by means of dielectric substrates 44, 45, and 46. The stripline circuit shown in FIG. 11 is extended to the integrated infinite balun of the interleaved log periodic antenna as shown in FIGS. 12(*a*) to 12(*e*).

Figures 12A, 12B, 12C, 12D, 12E:
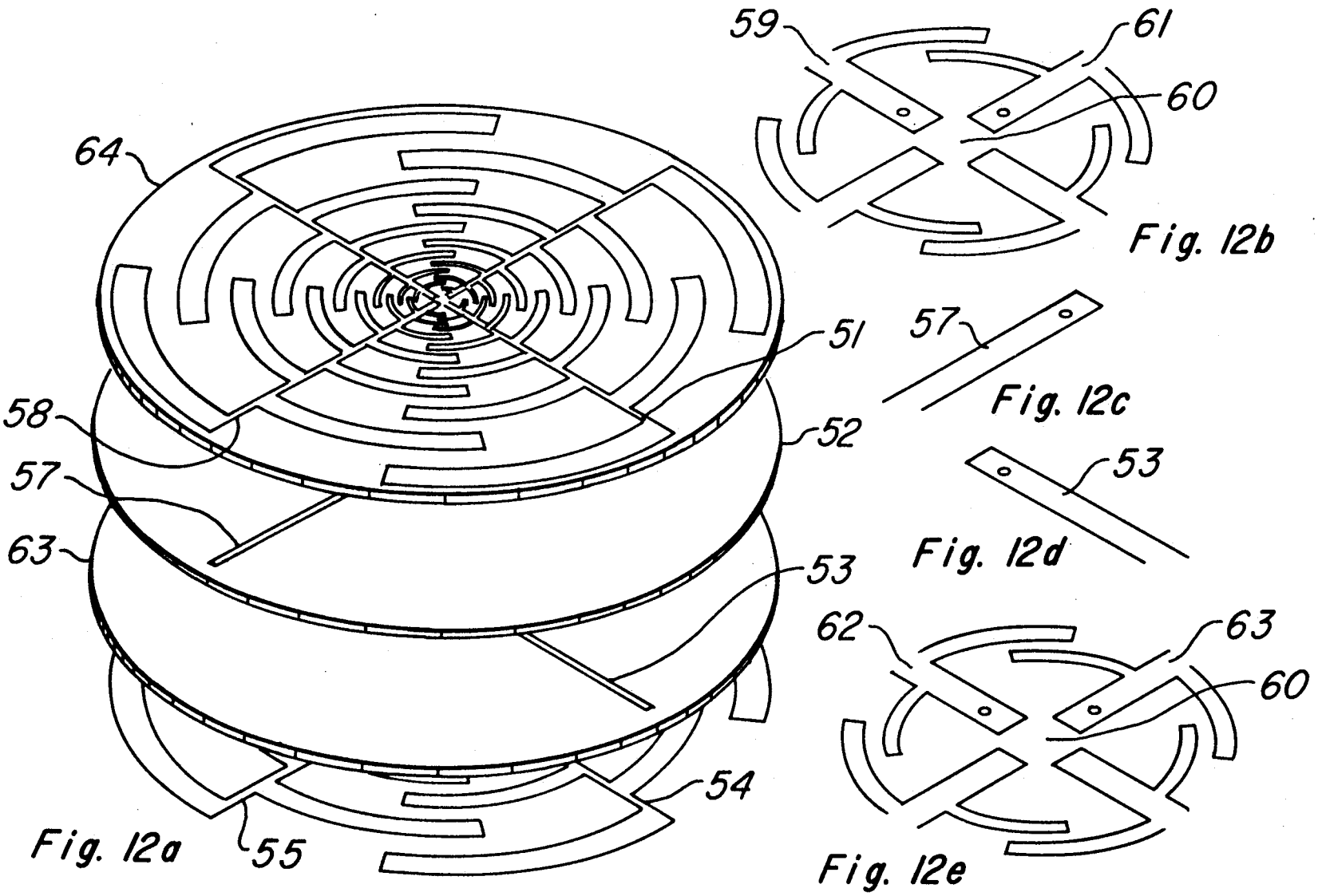
FIGS. 12(*a*) to 12(*e*) show the geometry for a stripline fed interleaved log periodic antenna.

Referring to FIG. 12(*a*) to 12(*e*), two orthogonal and radial stripline feeds 53 and 57 are contained on opposite sides of a very thin (approximately 0.006 inch) dielectric substrate 52. Radial stripline feeds 53 and 57 are contained between conductors 51 and 54 plus 55 and 58 respectively. The center stripline conductors 53 and 57 bridge a small gap 60 at the center feed point (see exploded view in FIG. 12(*a*)) and connect to radial feed lines 59 and 62 plus 61 and 63 respectively via a shorting pin or plated through hole. The log periodic pattern is etched and registered on upper and under sides of the substrate 63 and 64. The stripline fed antenna is connected to the coaxial feeding transmission line at the outer perimeter of the structure in a similar manner to that shown in FIG. 5. In FIG. 5, the coaxial transmission line center conductor connects to the microstrip (stripline) center conductor and the coaxial transmission line shield connects to the log periodic elements at the outer perimeter. For either the microstrip or stripline feed method, the key reliability feature is retained because no transmission line passing along the antenna axis, perpendicular to the plane of the antenna, is connected to the central antenna feed point. Thus, the antenna is free to move up and down (diaphragm action) due to environmental conditions without causing feedpoint failure.

Another variation of the integrated printed circuit microstrip or stripline balun (which is an integral part of the antenna substrate) is to extend or continue the balun and substrate past the perimeter of the antenna elements. In this case the balun forms a flex circuit which may connect to the 90 degree hybrid, polarization selection switch or two dual output ports for dual linear operation.

Dual Mode Performance—The four orthogonal log periodic structures described in the previous paragraph are capable of providing a SUM pattern performance only, e.g. (peak of beam on the antenna axis) independent of frequency and polarization. For monopulse DF (direction finding) applications it is desirable to have a single antenna aperture capable of radiating both SUM and DIFFERENCE patterns simultaneously. The DIFFERENCE pattern has a null on the axis of the antenna. It is not possible to obtain a circular polarized DIFFERENCE pattern with four orthogonal linear polarized elements as shown in FIG. 2. In order to obtain a circular polarized difference pattern with linear polarized elements, one must employ a minimum of six linear polarized elements arranged in a hexagonal geometry Referring to FIG. 2, it becomes obvious that if one were to introduce six log periodic elements, the radial feed lines would interfere with the interleaved geometry. Thus, the geometry as shown in FIG. 2 is not suitable for six interleaved log periodic elements without some special design features.

Figure 10:
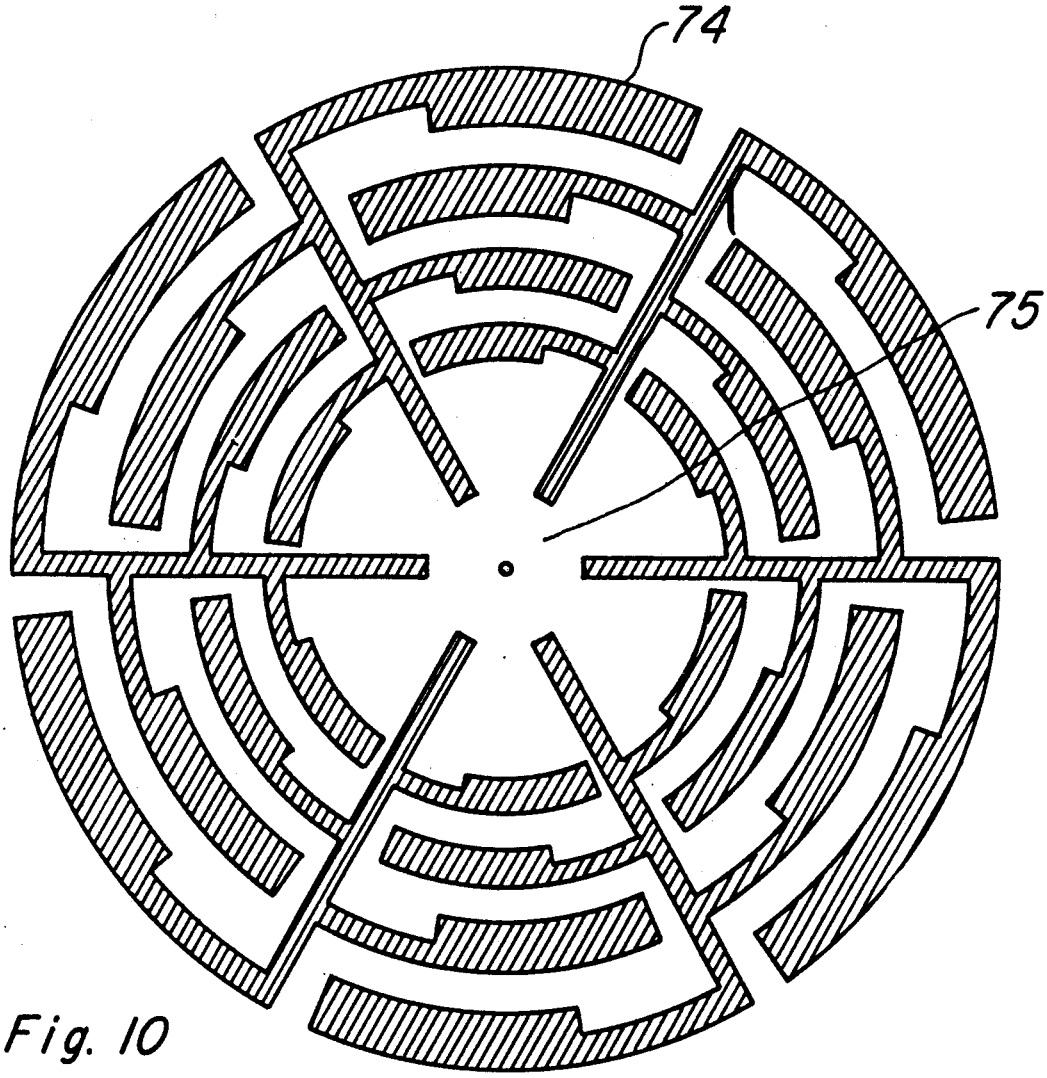
FIG. 10 shows a capacitively loaded interleaved log periodic antenna capable of simultaneous SUM and DIFFERENCE radiation pattern operation. This loading approach also is useful for the four port SUM mode antenna shown in FIG. 2 for applications where size reduction is a requirement.

Shown in FIG. 10 is the new design of log periodic elements which are foreshortened by means of capacitive loading. The capacitive loading tabs 74 foreshorten the log periodic dipole elements and allow six radial feeds to converge at a central feed point region 75. The capacitive loading tabs allow size reduction of the log periodic dipole elements by as much as 60 percent. For dual mode performance, the six ports must be feed with a six port RF processor capable of exciting both SUM and DIFFERENCE modes. For one sense of polarization of the SUM mode, the processor must feed each of the six feed ports with equal amplitude and a sixty degree phase progression around the feed region, e.g., 0, 60, 120, 180, 240, and 300 degrees. For the opposite sense of circular polarization of the SUM mode, the phase sequence is reversed, e.g., 0, 300, 240, 180, 120, and 60 degrees. For one sense of polarization of the DIFFERENCE mode, the processor must feed each of the six ports with equal amplitude and a one hundred twenty degree phase progression (twice that for the SUM mode) around the feed region, e.g., 0, 120, 240, 360, 480, and 600 degrees. For the opposite sense of circular polarization of the DIFFERENCE mode, the phase sequence is reversed, e.g., 0, 600, 480, 360, 240, and 120 degrees. Thus it is possible to realize a single antenna aperture capable of providing dual sense circular polarization for both SUM and DIFFERENCE modes for monopulse direction finding applications.

An additional benefit of the capacitive loading (foreshortening) technique illustrated in FIG. 10 is that of size reduction of the radiating aperture. This allows a dual polarized aperture to be electrically large for low frequency performance where the wavelength is long and physically small. This is attractive for many airborne applications where installation space constraints are critical.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

We claim:

1. A multi-polarized broad band antenna which comprises:

(a) a substrate; and (b) an antenna structure disposed on said substrate, said antenna structure including:

(c) a central feedpoint;

(d) first and second spaced apart signal injection/extraction connections disposed remote from said central feedpoint at the outer perimeter of said antenna structure;

(e) a first radial transmission line extending from said central feed point to said first signal injection/extraction connection at said outer perimeter of said antenna;

(f) a first antenna element having a plurality of elements defined by electrically conductive interconnected concentric circular sectors of diminishing radius extending from said outer antenna perimeter to said central feedpoint;

(g) a second antenna element having a plurality of elements defined by electrically conductive interconnected concentric circular sectors of diminishing radius extending from said outer antenna perimeter to said central feedpoint, said second plural circular sectors being interleaved with said first plural circular sectors;

(h) a second radial transmission line rotated ninety degrees from said first transmission line and extending from said central feedpoint to said second signal injection/extraction connection at said antenna perimeter;

(i) a third antenna element having a plurality of elements defined by electrically conductive interconnected concentric circular sectors of diminishing radius extending from said outer antenna perimeter to said central feedpoint, said third plural circular sectors being interleaved with said second plural circular sectors;

(j) a third radial transmission line rotated ninety degrees from said second transmission line and extending from said central feedpoint to said antenna perimeter and disposed opposite said first transmission lines;

(k) a fourth antenna element having a plurality of elements defined by electrically conductive interconnected concentric circular sectors of diminishing radius extending from said outer antenna perimeter to said central feedpoint, said fourth plural circular sectors being interleaved with said first and third plural circular sectors;

(l) a fourth radial transmission line rotated ninety degrees from said third transmission line and extending from said central feedpoint to said antenna perimeter and disposed opposite said second transmission line;

(m) said first and third radial transmission lines forming a small gap defining said central feedpoint and extending in opposite directions from said central feedpoint for launching a signal at said central feedpoint travelling radially outward/inward to the resonant said conductive circular sectors.

2. An antenna as set forth in claim 1 further including a plurality of microstrips, striplines or coaxial transmission line infinite baluns on said substrate, each extending from one of said injection/extraction connections to said central feedpoint and oriented ninety degrees from each other.

3. An antenna as set forth in claim 1 wherein said first plurality of antenna elements is disposed on one surface of said substrate and said second plurality of antenna elements is disposed on the opposite surface of said substrate.

4. An antenna as set forth in claim 2 wherein said first plurality of antenna elements is disposed on one surface of said substrate and said second plurality of antenna elements is disposed on the opposite surface of said substrate.

5. An antenna as set forth in claim 1 wherein said first plurality of antenna elements are alternately disposed on opposite sides of said first transmission line and said second plurality of antenna elements are alternately disposed on opposite sides of said second transmission line.

6. An antenna as set forth in claim 2 wherein said first plurality of antenna elements are alternately disposed on opposite sides of said first transmission line and said second plurality of antenna elements are alternately disposed on opposite sides of said second transmission line.

7. An antenna as set forth in claim 3 wherein said first plurality of antenna elements are alternately disposed on opposite sides of said first transmission line and said second plurality of antenna elements are alternately disposed on opposite sides of said second transmission line.

8. An antenna as set forth in claim 4 wherein said first plurality of antenna elements are alternately disposed on opposite sides of said first transmission line and said second plurality of antenna elements are alternately disposed on opposite sides of said second transmission line.

9. An antenna as set forth in claim 5, further including a shorting pin coupling said first and second transmission lines at said feedpoint.

10. An antenna as set forth in claim 6, further including a shorting pin coupling said first and second transmission lines at said feedpoint.

11. An antenna as set forth in claim 7, further including a shorting pin coupling said first and second transmission lines at said feedpoint.

12. An antenna as set forth in claim 8, further including a shorting pin coupling said first and second transmission lines at said feedpoint.

13. An antenna as set forth in claim 5 further including a microstrip disposed on said substrate coupling together said first and second transmission lines at said feedpoint.

14. An antenna as set forth in claim 6 further including a microstrip disposed on said substrate coupling together said first and second transmission lines at said feedpoint.

15. An antenna as set forth in claim 7 further including a microstrip disposed on said substrate coupling together said first and second transmission lines at said feedpoint.

16. An antenna as set forth in claim 8 further including a microstrip disposed on said substrate coupling together said first and second transmission lines at said feedpoint.

17. An antenna as set forth in claim 1, further including a first coaxial line coupled to said first signal injection/extraction connection and a second coaxial line coupled to said second signal injection/extraction connection.

18. An antenna as set forth in claim 2, further including a first coaxial line coupled to said first signal injection/extraction connection and a second coaxial line coupled to said second signal injection/extraction connection.

19. An antenna as set forth in claim 3, further including a first coaxial line coupled to said first signal injection/extraction connection and a second coaxial line coupled to said second signal injection/extraction connection.

20. An antenna as set forth in claim 4, further including a first coaxial line coupled to said first signal injection/extraction connection and a second coaxial line coupled to said second signal injection/extraction connection.

21. An antenna as set forth in claim 5, further including a first coaxial line coupled to said first signal injection/extraction connection and a second coaxial line coupled to said second signal injection/extraction connection.

22. An antenna as set forth in claim 6, further including a first coaxial line coupled to said first signal injection/extraction connection and a second coaxial line coupled to said second signal injection/extraction connection.

23. An antenna as set forth in claim 7, further including a first coaxial line coupled to said first signal injection/extraction connection and a second coaxial line coupled to said second signal injection/extraction connection.

24. An antenna as set forth in claim 8, further including a first coaxial line coupled to said first signal injection/extraction connection and a second coaxial line coupled to said second signal injection/extraction connection.

25. An antenna as set forth in claim 9, further including a first coaxial line coupled to said first signal injection/extraction connection and a second coaxial line coupled to said second signal injection/extraction connection.

26. An antenna as set forth in claim 10, further including a first coaxial line coupled to said first signal injection/extraction connection and a second coaxial line coupled to said second signal injection/extraction connection.

27. An antenna as set forth in claim 11, further including a first coaxial line coupled to said first signal injection/extraction connection and a second coaxial line coupled to said second signal injection/extraction connection.

28. An antenna as set forth in claim 12, further including a first coaxial line coupled to said first signal injection/extraction connection and a second coaxial line coupled to said second signal injection/extraction connection.

29. An antenna as set forth in claim 13 further including a first coaxial line coupled to said first signal injection/extraction connection and a second coaxial line coupled to said second signal injection/extraction connection.

30. An antenna as set forth in claim 14, further including a first coaxial line coupled to said first signal injection/extraction connection and a second coaxial line coupled to said second signal injection/extraction connection.

31. An antenna as set forth in claim 15 further including a first coaxial line coupled to said first signal injection/extraction connection and a second coaxial line coupled to said second signal injection/extraction connection.

32. An antenna as set forth in claim 16, further including a first coaxial line coupled to said first signal injection/extraction connection and a second coaxial line coupled to said second signal injection/extraction connection.

33. An antenna as set forth in claim 1 wherein said first plurality of antenna elements is disposed on one surface of said substrate, said second plurality of antenna elements is disposed on the opposite surface of said substrate, said third plurality of antenna elements is disposed on one surface of said substrate and said fourth plurality of antenna elements is disposed on the opposite surface of said substrate.

34. An antenna as set forth in claim 33 further including a first shorting pin coupling said first and second transmission lines at said feedpoint and a second shorting pin coupling said third and fourth transmission lines as said feedpoint.

35. An antenna as set forth in claim 33 further including a first microstrip disposed on said substrate coupling together said first and second transmission lines at said feedpoint and a second microstrip disposed on said substrate coupling together said third and fourth transmission lines at said feedpoint.

36. An antenna as set forth in claim 33, further including a first coaxial line coupled to said first signal injection/extraction connection, a second coaxial line coupled to said second signal injection/extraction connection, a third coaxial line coupled to said third signal injection/extraction connection and a fourth coaxial line coupled to said fourth signal injection/extraction connection.

37. An antenna as set forth in claim 34, further including a first coaxial line coupled to said first signal injection/extraction connection, a second coaxial line coupled to said second signal injection/extraction connection, a third coaxial line coupled to said third signal injection/extraction connection and a fourth coaxial line coupled to said fourth signal injection/extraction connection.

38. An antenna as set forth in claim 35, further including a first coaxial line coupled to said first signal injection/extraction connection, a second coaxial line coupled to said second signal injection/extraction connection, a third coaxial line coupled to said third signal injection/extraction connection and a fourth coaxial line coupled to said fourth signal injection/extraction connection.

39. An antenna which comprises:

(a) an electrically insulating substrate having a perimeter;

(b) an antenna pattern disposed on said substrate having a central feedpoint, a portion of said antenna pattern extending to said perimeter of said substrate, wherein said antenna pattern includes:

(i) a first antenna element having a plurality of first regions, each of said first regions composed of first plural interconnected concentric sectors of circles of diminishing radius extending to said feedpoint, (ii) a second antenna element having a plurality of second regions, each of said second regions composed of second plural interconnected concentric sectors of circles of diminishing radius extending to said feedpoint, and (iii) an infinite balun on said substrate interconnecting said sectors of circles and said connection, (c) a signal injection/extraction connection coupled to said antenna pattern at said perimeter of said electrically insulating substrate; and (d) a transmission line coupled to said connection at a location on said antenna pattern remote from said central feedpoint and at said perimeter of said electrically insulating substrate.

40. An antenna as set forth in claim 39 wherein said infinite balun is one of a microstrip, a stripline or a coaxial transmission line.

* * * * *